US006307188B1

(12) United States Patent
Bulgajewski

(10) Patent No.: US 6,307,188 B1
(45) Date of Patent: Oct. 23, 2001

(54) HEATER WITH PTC ELEMENT AN BUSS SYSTEM

(75) Inventor: Edward Bulgajewski, Genowa, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/579,286

(22) Filed: May 25, 2000

Related U.S. Application Data

(63) Continuation of application No. 09/281,099, filed on Mar. 29, 1999, now Pat. No. 6,084,217, which is a continuation-in-part of application No. 09/189,382, filed on Nov. 9, 1998, now abandoned.

(51) Int. Cl.[7] ..... H05B 1/02
(52) U.S. Cl. ..... 219/505; 219/541
(58) Field of Search ..... 219/505, 504, 219/490, 482, 219, 203, 543, 553, 541

(56) References Cited

U.S. PATENT DOCUMENTS

| | | | | |
|---|---|---|---|---|
| 4,410,790 | * | 10/1983 | Berg et al. | 219/219 |
| 4,628,187 | * | 12/1986 | Sekiguchi et al. | 219/505 |
| 4,743,741 | * | 5/1988 | Ramus | 219/543 |
| 4,857,711 | * | 8/1989 | Watts | 219/548 |
| 4,931,627 | * | 6/1990 | Watts | 219/548 |
| 5,015,824 | * | 5/1991 | Monter et al. | 219/219 |
| 5,132,840 | * | 7/1992 | Okada et al. | 359/512 |
| 5,181,006 | * | 1/1993 | Shafe et al. | 338/22 R |
| 5,206,482 | * | 4/1993 | Smuckler | 219/219 |
| 5,354,966 | * | 10/1994 | Sperbeck | 219/203 |
| 5,418,025 | * | 5/1995 | Harmand et al. | 428/38 |
| 5,702,565 | * | 12/1997 | Wu et al. | 264/400 |
| 5,902,505 | * | 5/1999 | Finley | 219/547 |
| 5,904,874 | * | 5/1999 | Winter | 219/544 |

* cited by examiner

*Primary Examiner*—Teresa Walberg
*Assistant Examiner*—Daniel Robinson
(74) *Attorney, Agent, or Firm*—Pitney, Hardin, Kipp & Szuch LLP

(57) ABSTRACT

The heater is formed from a substrate layer, a feeder buss layer, a dielectric layer, a PTF (polymer thick film) conductor or main buss layer, a PTC (positive temperature coefficient) thermistor layer and an external laminated adhesive layer. All of the layers are substantially coextensive. The feeder buss layer, dielectric layer, main buss layer and PTC thermistor layers are preferably screen printed or otherwise selectively applied. The feeder buss layer includes first and second external electrical terminals formed on a single side thereof, and a buss for providing electrical communication from the first terminal to a connector diagonally removed from the second terminal. The connector and the second terminal provide electrical communication to diagonally opposed corners of the PTF conductor or main buss layer thereby providing relatively uniform current path distances through the thermistor layer.

16 Claims, 4 Drawing Sheets

HEATER WITH PTC ELEMENT AN BUSS SYSTEM

This application is a cont of Ser. No. 09/281,099 filed Mar 29, 1999, U.S. Pat. No. 6,084,217, which is a continuation-in-part of application Ser. No. 09/189,382, entitled "Dual Heater with PTC and Fixed Resistance Elements" filed on Nov. 9, 1998, now ABN the disclosure of which is hereby incorporated by reference.

BACKGROUND OF THE INVENTION

1. Field of the Invention

This invention pertains to a heater pad with a PTC (positive temperature coefficient) element and a buss system to equalize the current path distances.

2. Description of the Prior Art

In the prior art, PTC (positive temperature coefficient) heaters, such as those disclosed in U.S. Pat. Nos. 4,857,711 and 4,931,627 to Watts, have a resistance which increases in response to increasing temperatures. This fundamentally reduces thermal energy output in view of a substantially constant voltage applied across this resistance, thereby tending to prevent overheating, and is therefore useful in applications with varying ambient temperatures, such as automotive mirror defrosting. Users in several applications desire a heater with both terminals across a single face of the heater in order to simplify electrical connections and to accommodate standard electrical circuitry. However, such a configuration often results in uneven resistance through the various electrical paths thereby resulting in uneven heating across the heating surface, increased current draw, and increased buss width requirements.

OBJECTS AND SUMMARY OF THE INVENTION

It is therefore an object of this invention to provide a heater with PTC (positive temperature coefficient) characteristics which has relatively uniform heating characteristics across its heating surface.

It is therefore a still further object of this invention to provide heater with PTC characteristics which has relatively uniform resistance through the various electrical paths of its heating surface.

It is therefore a still further object of this invention to provide a heater with PTC characteristics which has a reduced current draw.

It is therefore a still further object of this invention to provide a heater with PTC characteristics which has reduced requirements with respect to main buss width.

It is therefore a still further object of this invention to provide a heater with PTC characteristics which has electrical terminals across a single face in order to accommodate standard electrical connections.

These and other objects are attained by providing a heater with a feeder buss layer formed on a polyester substrate. The feeder buss layer includes conducting portions which provide electrical communication from the terminals through conducting conduits in two diagonally opposed corners in an adjacent dielectric layer. The conducting conduits are further in electrical communication with diagonally opposed corners of an adjacent main buss layer (otherwise known as a PTC conductor layer). The main buss layer provides current to the adjacent PTC thermistor layer. An adhesive layer may be formed adjacent to the PTC thermistor layer to provide electrical insulation and to provide the ability to fasten the heater to an adjacent surface, such as an automotive mirror.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
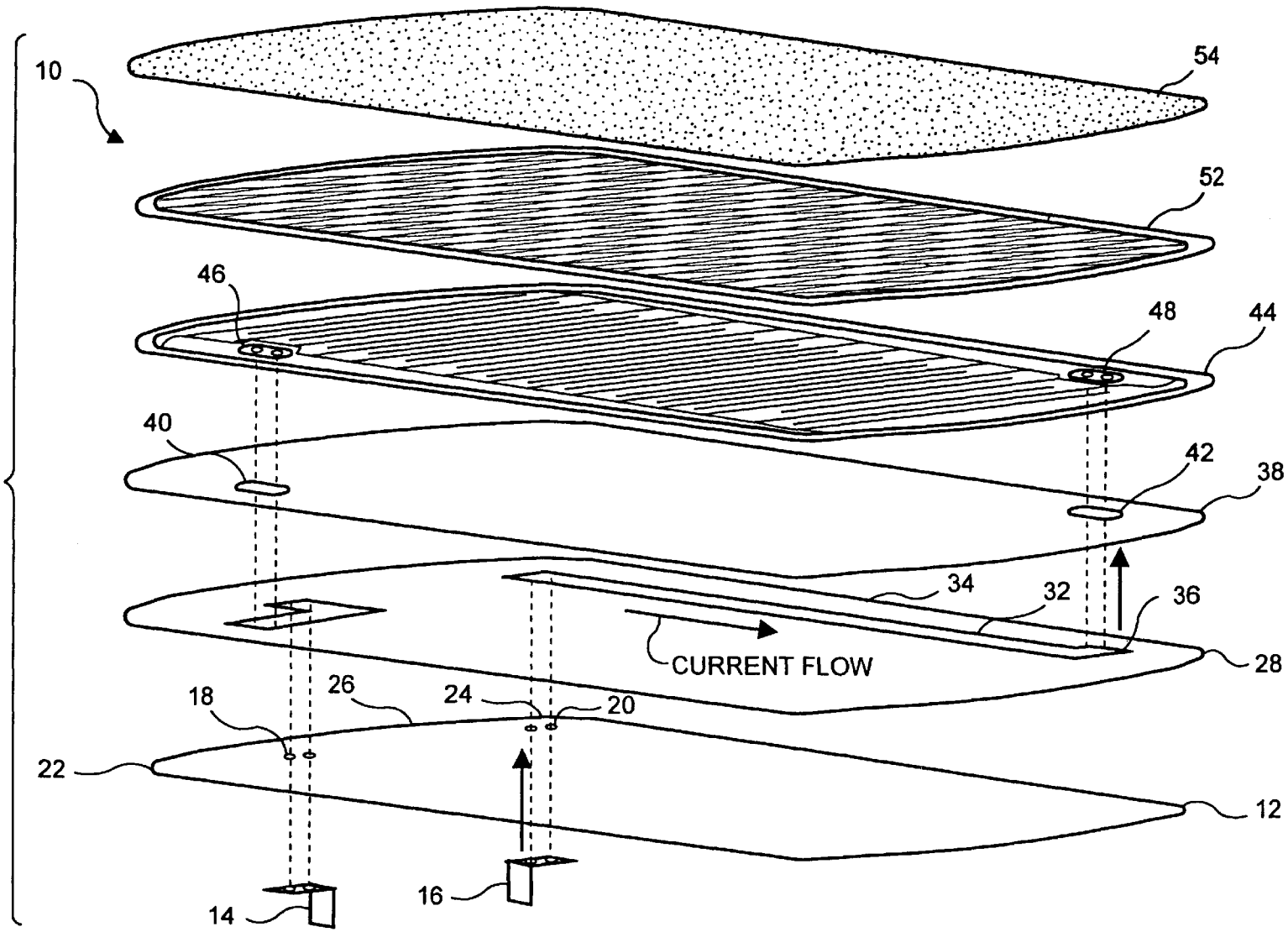
FIG. 1 is an exploded view of the heater of the present invention.
Figure 2:
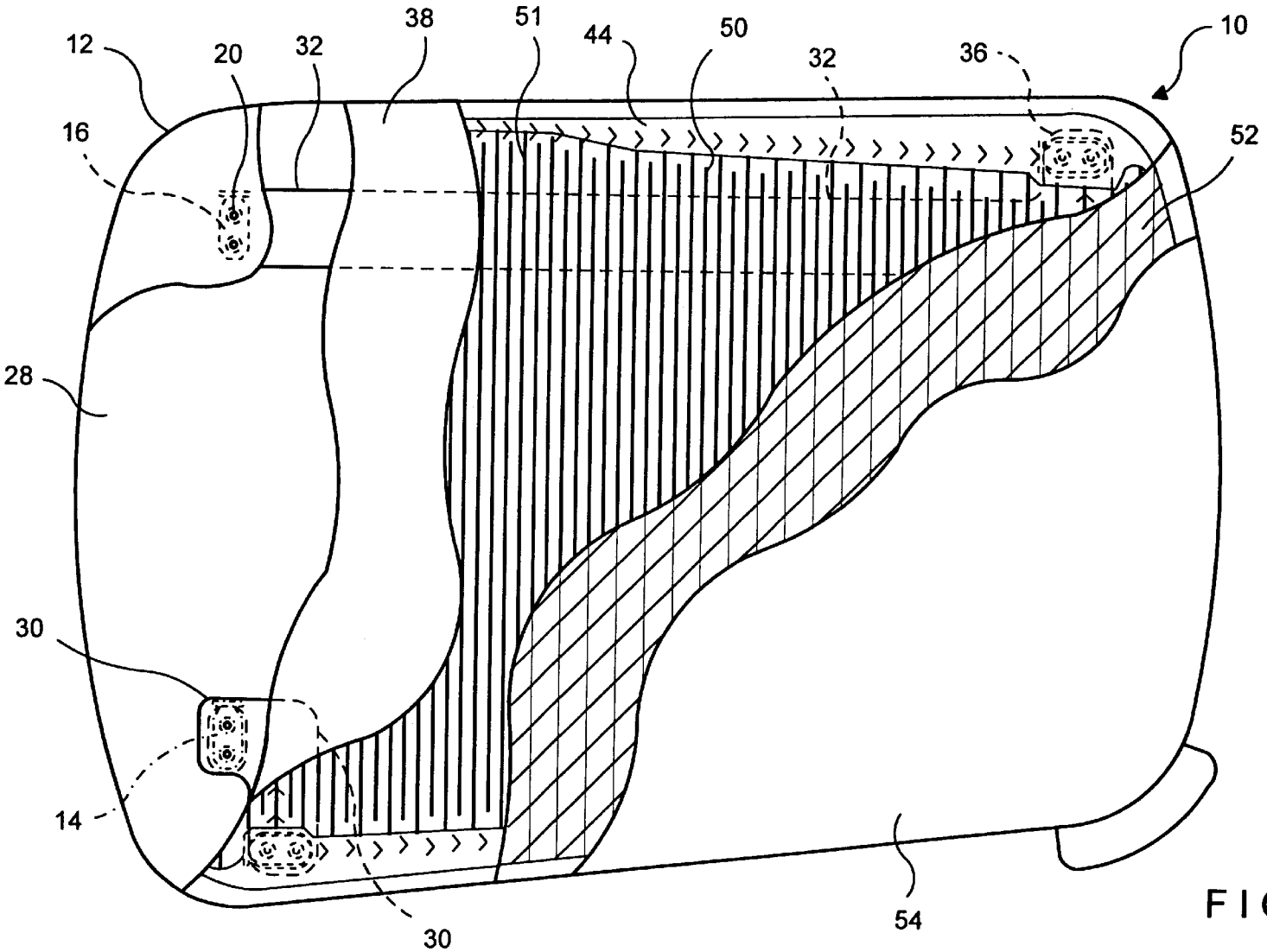
FIG. 2 is a plan view of the heater of the present invention.

Referring now to the drawings in detail wherein like numerals indicate like elements throughout the various views, one sees that FIG. 1 is an exploded view of heater 10 of the present invention. As shown in FIG. 2, heater 10 is illustrated in a generally rectangular shape with rounded corners, as may be provided to defrost an automotive rear view mirror. However, other shapes are appropriate for other applications.

Polyester substrate 12 provides a support for the subsequent layers of the heater as well as electrical insulation. Polyester substrate 12, as well as all other layers described hereinafter, are preferably of generally the same shape and size as the heater 10 and are generally coextensive therewith. Positive and negative electrical terminals 14, 16 pass through terminal eyelets 18, 20, respectively, formed inwardly adjacent from corners 22, 24 of side 26 of polyester substrate 12. Electrical terminals 14, 16 being formed along a single side of heater 10 provides for simplified connection to an external voltage source (not shown).

Figure 3:
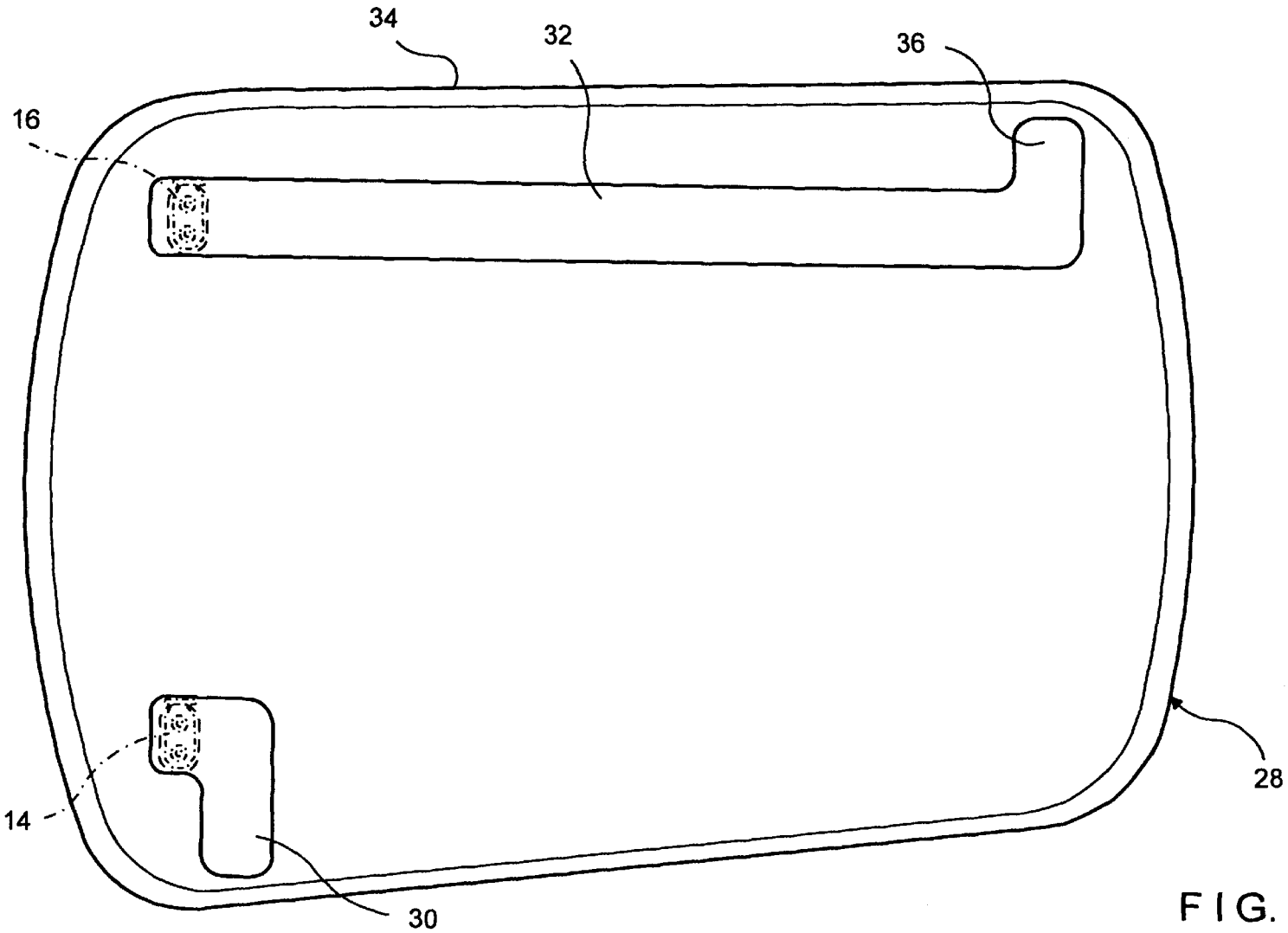
FIG. 3 is a plan view of the feeder buss layer of the heater of the present invention.

Selectively printed feeder buss layer 28 is adjacent to polyester substrate 12. Printed feeder buss layer 28 is preferably screen printed, but those skilled in the art will recognize that other printing methods are acceptable. Feeder buss layer 28 is formed of a conducting portion 30, in electrical communication with positive terminal 14. Feeder buss layer 28 further includes conducting buss 32 formed inwardly adjacent from side 34 of layer 28 (also see FIG. 3). Conducting buss 32 provides electrical communication between negative terminal 16 and extended terminal portion 36. Extended terminal portion 36 is formed at a corner diagonally opposite from conducting portion 30 and positive terminal 14.

Printed dielectric layer 38 is adjacent to feeder buss layer 28 and includes apertures 40, 42 at diagonally opposed corners thereof, through which conducting portion 30 (in electrical communication with positive terminal 14) and extended terminal portion 36 (in electrical communication with negative terminal 16) of feeder buss layer 28 pass, respectively. Printed dielectric layer 28 is preferably screen printed, but those skilled in the art will recognize that other printing methods are acceptable.

Figure 4:
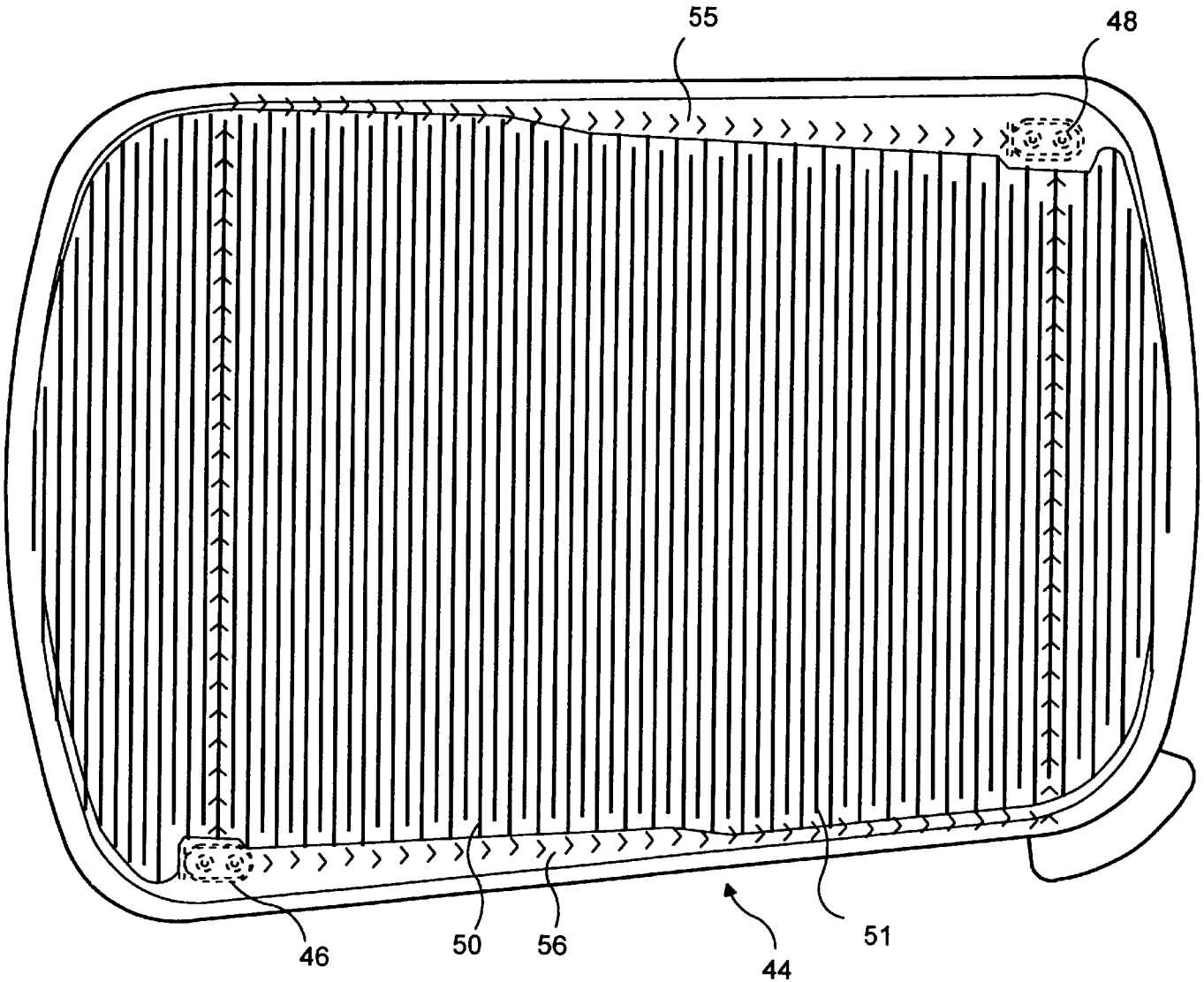
FIG. 4 is a plan view of the main buss or PTF conductor layer of the heater of the present invention.

PTF (polymer thick film) conductor (or printed silver main buss, by screen printing or other method) layer 44 is adjacent to dielectric layer 38. PTF conductor layer 44 includes, at diagonally opposite corners, positive terminal 46 in electrical communication with conducting portion 30 of feeder buss layer 28 and negative terminal 48 in electrical communication with extended terminal portion 36 of feeder buss layer 28. PTF conductor layer 44 includes parallel conducting elements 50 (see FIG. 4) in electrical communication with positive terminal 46 via buss 56, alternating with (and parallel to) parallel conducting elements 51 in electrical communication with negative terminal 48 via buss 55 for providing electrical communication to PTC thermistor layer 52 which is adjacent thereto. Parallel conducting elements 50 are in electrical communication with parallel conducting elements 51 substantially only through PTC thermistor layer 52. PTC thermistor layer 52 includes the thermal heating via the resistance with positive temperature coefficient characteristics (that is, increased resistance in response to increased temperature, thereby fundamentally providing reduced thermal heating when a substantially constant voltage is applied). PTC thermistor layer 52 is preferably screen printed, but those skilled in the art will recognize that other printing methods are acceptable. By applying the voltage between positive and negative terminals 46 and 48 at diagonally opposed corners of PTF conductor layer 44, the current path distances across PTF conductor layer 44 are substantially equalized (see the paths illustrated by arrows on FIG. 4) thereby resulting in more spatially uniform heat production across PTC thermistor layer 52, reduced current draw, and reduced width requirements for busses 55, 56.

Laminated adhesive layer 54 is adjacent to PTC thermistor layer 52. Laminated adhesive layer 54 provides electrical insulation and further provides a method of attachment to the surface being heated, such as the rear surface of an automotive exterior rear view mirror.

The resulting circuit is formed from the voltage source (not shown) through negative terminal 16, across buss 32 to extended terminal portion 36 and negative terminal 48 of PTF conductor layer 44 to parallel conducting elements 51, through PTC thermistor layer 52, through parallel conducting elements 50, to positive terminal 46 of PTC conductor layer 44, to conducting portion 30, to positive terminal 14 and back to the voltage source (not shown).

A variation of this embodiment is to provide the feeder buss layer 28 and dielectric layer 38 or laminated adhesive layer 54 on the opposite side of the polyester substrate 12 while using terminal eyelets 18, 20 (as appropriately relocated) as through apertures to connect the feeder buss layer 28 to the PTF conductor and PTC thermistor layers 44, 52.

To use heater 10, the installer attaches heater 10 to a surface to be heated and further provides a voltage source to terminals 14 and 16. The attachment of heater 10 can be performed using adhesive layer 54 or similar methods.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. An electrical heater comprising:

first and second busses disposed on a substrate in electrically isolated relation, the first and second busses electrically coupled with generally parallel conducting element portions and having corresponding first and second voltage application portions;

a thermistor layer electrically interconnecting the generally parallel conducting element portions;

a summation of electrical paths along the first and second busses from the first and second voltage application portions thereof to adjacent portions along the generally parallel conducting element portions is substantially the same.

2. The heater of claim 1, the thermistor layer comprises a positive temperature coefficient material.

3. The heater of claim 1, the first and second conducting element portions arranged in a generally rectangular pattern, the first and second voltage application portions located diagonally opposite each other.

4. The heater of claim 3, the first and second busses each electrically coupled with a plurality of interdigitated parallel conducting element portions, the summation of electrical paths along the first and second busses from the first and second voltage application portions thereof to adjacent portions along the interdigitated parallel conducting element portions is substantially the same.

5. The heater of claim 1, a first electrical terminal electrically coupled to said first voltage application portion of the first buss, a second electrical terminal electrically coupled to the second voltage application portion of the second buss, the first and second electrical terminals spaced more closely to each other than a spacing between the first and second voltage application portions of the first and second busses.

6. The heater of claim 5, the second electrical terminal electrically coupled to the second voltage application portion by a feeder buss located on a side of the substrate opposite the first and second busses.

7. An electrical heater comprising:

a substrate; first and second electrically isolated busses disposed on the substrate the first and second busses electrically coupled to generally parallel conducting element portions arranged in a generally rectangular pattern;

a first voltage terminal coupled to the first buss and a second voltage terminal coupled to the second buss, the first and second voltage terminals located diagonally opposite each other.

8. The heater of claim 7, a summation of electrical paths along the first and second busses from the first and second voltage terminals thereof to adjacent portions along the generally parallel conducting element portions is substantially the same.

9. The heater of claim 7, a first electrical terminal electrically coupled to the first voltage terminal, a second electrical terminal electrically coupled to the second voltage terminal, the first and second electrical terminals spaced more closely to each other than the spacing between the first and second voltage terminals.

10. The heater of claim 9, the second electrical terminal electrically coupled to the second voltage terminal by a feeder buss located on an opposite side of the substrate as the first and second busses.

11. The heater of claim 7, the first and second busses each electrically coupled to a plurality of interdigitated parallel conducting element portions, the summation of electrical paths along the first and second busses from the first and second voltage terminals thereof to adjacent portions along the interdigitated parallel conducting element portions is substantially the same.

12. In an electrical heater comprising an insulating substrate having first and second conducting elements disposed thereon interconnected by a positive temperature coefficient material, the improvement comprising:

the first and second conducting elements arranged substantially symmetrically in a generally rectangular pattern;

a first voltage terminal coupled to the first conducting element and a second voltage terminal coupled to the second conducting element, the first and second voltage terminals located in diagonally opposite corners of the generally rectangular pattern.

13. The improvement of claim 12, a summation of electrical paths along the first and second conducting elements from the first and second voltage terminals thereof to adjacent portions of the first and second conducting elements is substantially the same.

14. The improvement of claim 12, a first electrical terminal electrically coupled to the first voltage terminal, a second electrical terminal electrically coupled to the second voltage terminal, the first and second electrical terminals spaced more closely to each other than a spacing between the first and second voltage terminals.

15. The improvement of claim 14, the second electrical terminal electrically coupled to the second voltage terminal by a feeder buss located on a side of the substrate opposite the first and second conducting elements.

16. The improvement of claim 12, the first and second electrodes each having a plurality of interdigitated parallel electrode portions, the summation of electrical paths along the first and second electrodes from the first and second voltage terminals thereof to adjacent portions along the interdigitated parallel electrode portions is substantially the same.

* * * * *